United States Patent [19]

Hackworth et al.

[11] Patent Number: 4,782,962

[45] Date of Patent: Nov. 8, 1988

[54] BACK PACKABLE PORTABLE UNIT

[76] Inventors: Harry L. Hackworth; Gerald D. Mitchell, both of P.O. Box 15339, Tulsa, Okla. 74112

[21] Appl. No.: 348,816

[22] Filed: Feb. 16, 1982

[51] Int. Cl.[4] ..... B66C 23/72; B66C 23/06; A45F 4/02

[52] U.S. Cl. ..... 212/195; 224/153; 212/178; 212/182; 212/187; 212/255; 212/263; 212/264; 212/265

[58] Field of Search ..... 212/175, 178, 182, 183, 212/186, 187, 188, 189, 195, 196–197, 230–231, 239, 241, 244, 255, 260, 263–265; 224/151, 153

[56] References Cited

U.S. PATENT DOCUMENTS

| | | | |
|---|---|---|---|
| 2,569,821 | 10/1951 | Maxeiner | 212/195 |
| 3,978,989 | 9/1976 | Avila, Jr. | 212/189 |
| 4,135,627 | 1/1979 | McInerney | 212/195 |
| 4,310,098 | 1/1982 | Dirksen | 212/195 |

FOREIGN PATENT DOCUMENTS

| | | | |
|---|---|---|---|
| 2254074 | 5/1974 | Fed. Rep. of Germany | 212/195 |
| 1013528 | 7/1952 | France | 212/260 |
| 379190 | 8/1932 | United Kingdom | 212/244 |
| 849782 | 9/1960 | United Kingdom | 212/255 |
| 1273381 | 5/1972 | United Kingdom | 212/265 |

*Primary Examiner*—Joseph F. Peters, Jr.
*Assistant Examiner*—R. B. Johnson
*Attorney, Agent, or Firm*—Head & Johnson

[57] ABSTRACT

A portable, backpackable crane lift involving a retractable boom, boom cable, winch and winch cable mounted to a wheeled frame with extendable axles all which fold into a compact unit. A shoulder harness apparatus which attaches to the folded unit for carrying converts to a ballast carrying extension of the frame during operation. Such a lift is readily carried up a ladder for use on flat roofs to raise and place air conditioning heat exchangers and the like.

2 Claims, 3 Drawing Sheets

BACK PACKABLE PORTABLE UNIT

BACKGROUND OF THE INVENTION

1. Field of the Invention

This invention relates to an improved portable lift. More specifically it relates to a backpackable lift that can be carried up a ladder to a flat roof or the like.

2. Description of the Prior Art

The basic concept of employing a derrick or crane to lift heavy objects has long been established and employed commercially in a variety of applications. Thus the fundamental principle of employing a boom anchored to a base with a boom line and a hoist with hoist cable is common knowledge. Similarly various attempts to make such devices portable have long been suggested and practised including the barge derrick, locomotive crane, truck crane, crawler crane, overhead bridge crane and the like. However, it is still commonplace to see a very large crane being used to deliver relatively small air conditioning units and the like to roof tops during construction or repair at inordinate high expense. Thus, the need for a portable, compact lift which can be conveniently and manually carried to a roof top or the like and then employed to lift heavy objects still exists.

SUMMARY OF THE INVENTION

In view of prior art devices and their associated deficiencies, we have discovered an improved portable lift comprising: (a) a frame mounted on wheels such that the frame is essentially horizontal during operation; (b) a boom pivotally attached to one end of the frame and adapted to extend beyond the frame during operation and fold back upon the frame during transportation and storage; (c) a boom support means attached to the frame and adapted to maintain the boom in an elevated position during operation and fold back upon the frame during transportation and storage; (d) a hoist with hoist cable attached to the frame with the hoist cable threaded through a pulley on the end of the boom for raising a load attached to the end of the cable; and (e) a carrying means for assisting in the transportation of the portable lift when folded. The means to carry the folded lift can be something as simple as a handle or pair of handles or even merely provision on the frame to manually grip and lift the device., In one preferred embodiment the lift is further provided with a backpackable means that is removably attached to the underside of the frame and adapted to strap to the shoulders during manual transportation. This same backpackable means can be further adapted to attach to the frame extending horizontally away from the boom such as to accept ballast to compensate for the load being raised by the hoist. The invention further provides for the axles of at least one set of wheels to extend sideways to ensure stability during use and for the boom to be extendable during use to adjust its height, with both being retractable for ease of transportation and storage.

A primary object of the present invention is to provide a crane hoist that can be used on flat roofs for lifting and installing air conditioning units and the like. It is an object that the crane hoist fold into a compact unit that can be readily carried up a ladder. Fulfillment of these objects and the presence and fulfillment of other objects will be apparent upon complete reading of the specification and claims taken in conjunction with the attached drawings.

DESCRIPTION OF THE PREFERRED EMBODIMENT

Figures 1, 5:
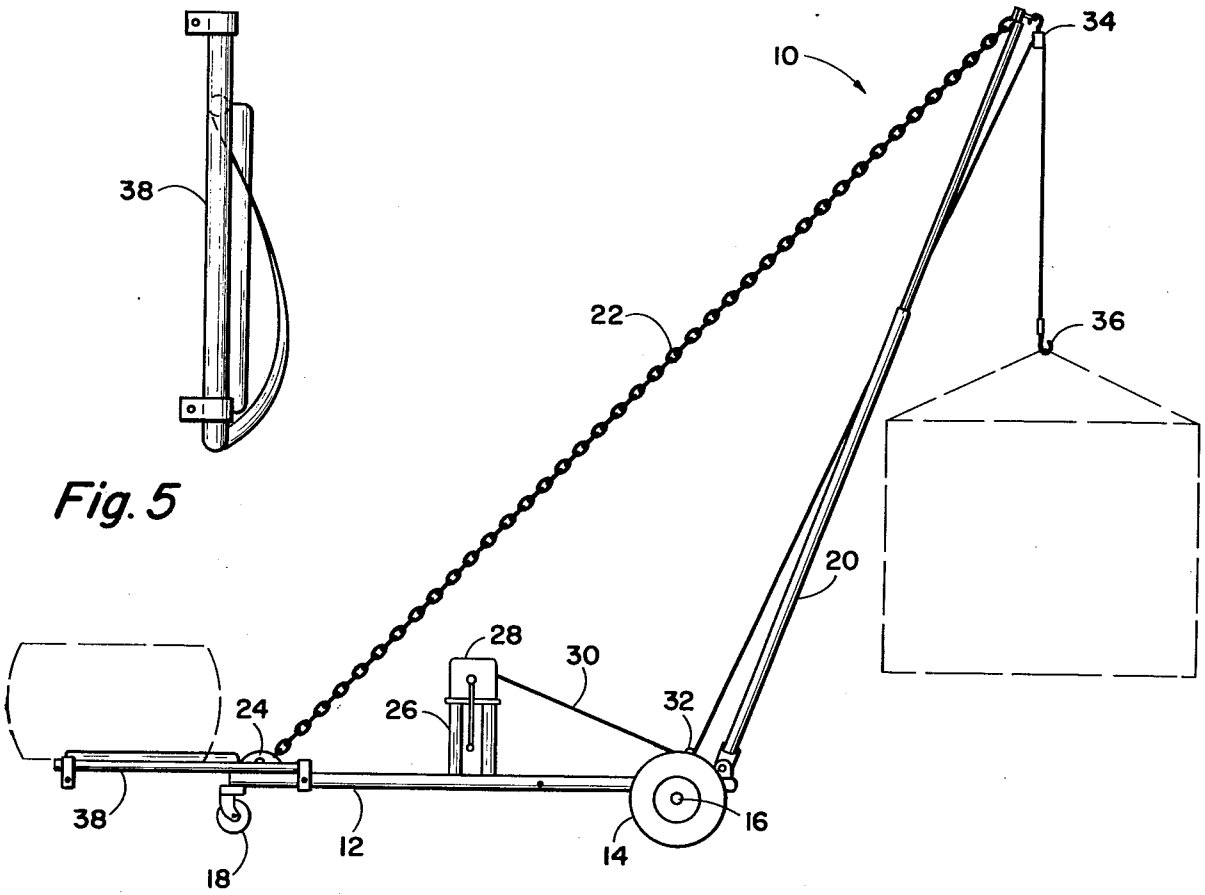
FIG. 1 is a side view of the backpackable, portable lift according to the present invention during
FIG. 5 is a side view of the attachable backpackable carrying means.

The backpackable portable lift of the present invention, how it operates and the advantages over what has previously been employed in the art can perhaps be best explained and understood by reference to the drawings. FIG. 1 illustrates a side view of a portable lift generally designated by the numeral 10 in a fully extended operational mode. The lift 10 comprises a horizontal frame 12 supported by a set of front wheels 14 and axles 16 and a rear set of wheeled casters 18. Pivotally attached to the front of frame 12 is an extendable A-frame boom or jib 20 supported at the top by boom line chain 22 held in tension to the rear of the frame 12 by an adjustable chain anchor 24. Centrally located on the frame 12 is a winch stand 26 and manual winch 28. The winch cable 30 threads through a lower frame pulley 32 and an upper boom pulley 34 terminating in an attachment hook 36. To the upper rear portion of the frame 12 is a detachable extension 38 provided to accept ballast to compensate for the load applied at the lifting hook 36 during operation.

Figure 2:
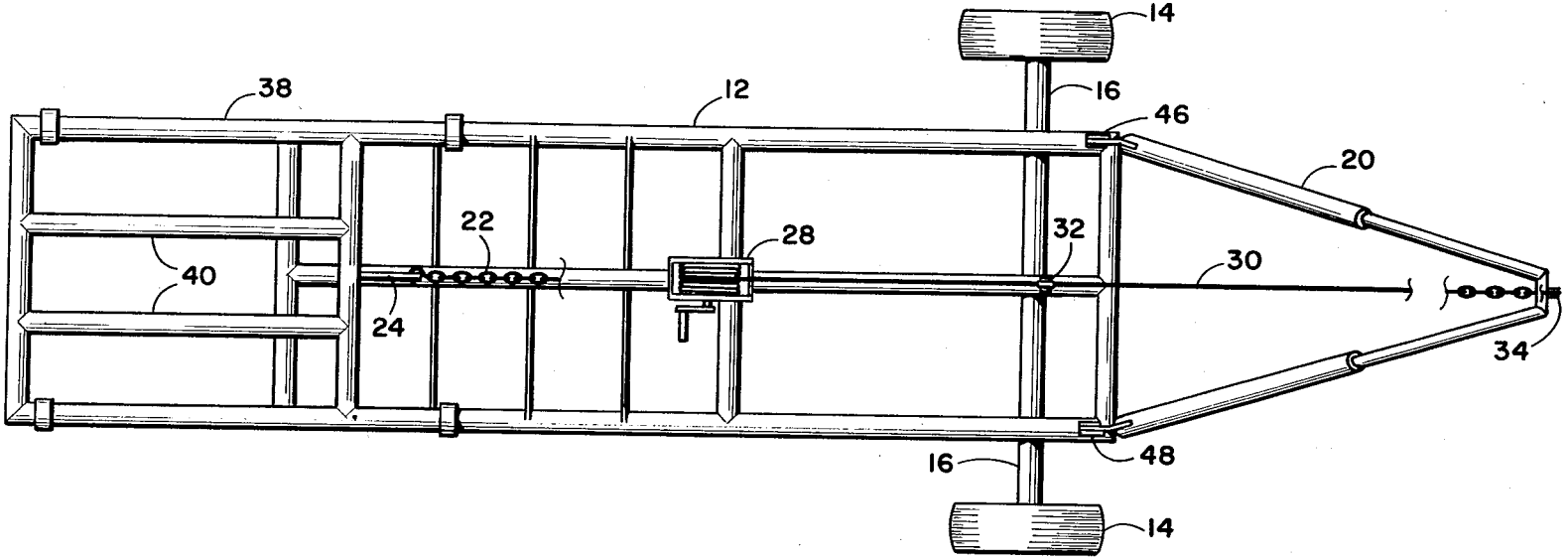
FIG. 2 is a top view of the lift of FIG. 1.

FIG. 2 is a top view of the portable lift illustrated in FIG. 1 with the retractable front axles 16 and wheels 14 in a compact position. The retactable A-frame boom 20 is in a fully extended position and the removable ballast extension member 38 to the rear of the frame 12 is also fully extended. In the middle of the ballast extension member 38 is a pair of parallel padded shoulder support members 40 used to carry the lift as explained later.

Figure 3:
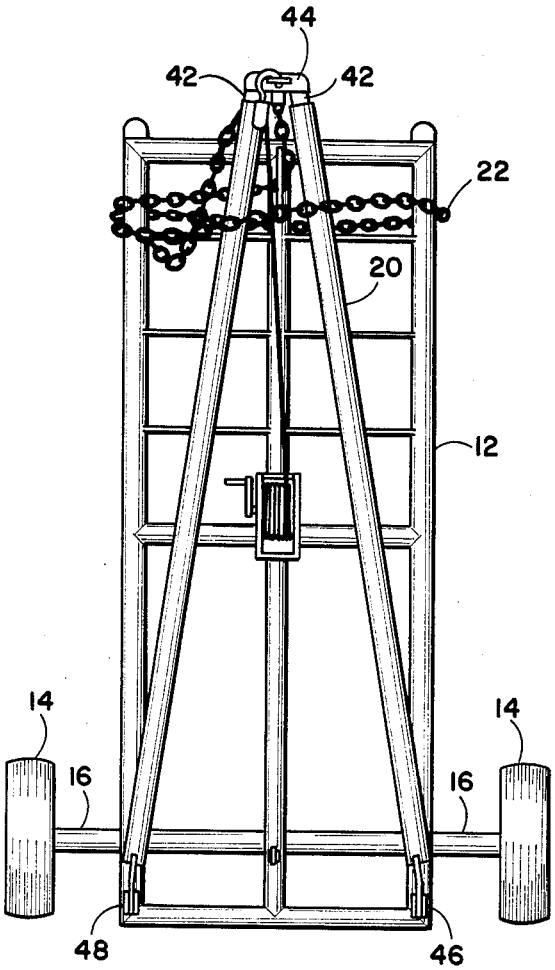
FIG. 3 is a top view of the lift of FIG. 1 in a folded configuration employed during transportation and storage.
Figure 4:
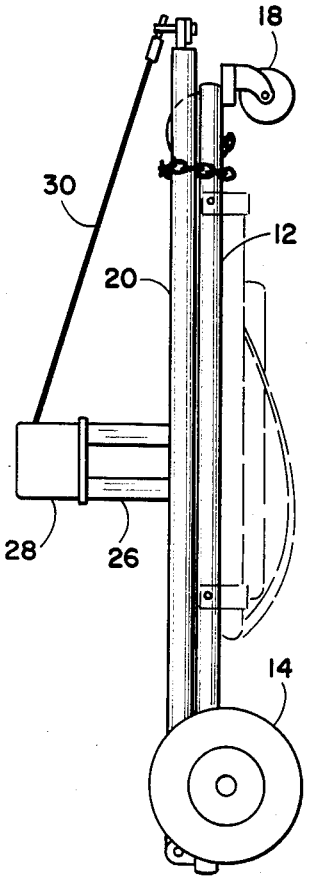
FIG. 4 is a side view of the folded lift of FIG. 3.

FIG. 3 illustrates the portable lift 10 of FIG. 1 in a folded configuration. As shown, the arms 42 of A-frame boom 20 retract into themselves with the top of the boom pivoting on the axis of the eyelet 44. Sufficient tolerance is provided at the points of attachment 46 and 48 of boom 20 to frame 12 to allow for the extension and retraction of boom arms 42. The boom 20 folds back flat against the frame 12 with ballast extension member 38 removed. The boom line chain 22 is wrapped around the frame 12 and boom 20 to secure the structure during transportation and storage. The winch hook 36 is connected to the end of boom chain 22 and slack in the winch cable 30 is removed such as to hold the winch cable and boom chain under mild tension. Again the wheels 14 are in a retracted position by virtue of telescoping the wheel axles 16. In this compact state the portable lift 10 can be easily transported in a dolly-like manner. FIG. 4 illustrates a side view of the folded portable lift of FIG. 3 while FIG. 5 is a side view of ballast extension member 38 to be attached to the underside of frame 12 at points of attachment 52 (see silhouette of FIG. 4). When attached, the entire assembly can be strapped to the shoulders of a workman by backing up to the shoulder pad members 40 and slipping the removable straps 50 around the arms and/or chest. In this manner the device can be backpacked from one location to the next including up stairs, and ladders or the like. Having carried the lift to the desired location (e.g. to a flat roof) the assembly can be readily converted to the configuration of FIGS. 1 and 2 by reversing the above procedure. The lift can be manufactured out of conventional light weight materials by any of the conventional methods. Structural materials such as tubular steel, tubular aluminum, or their structural equivalents are preferred. Since reduction of weight is considered important tubular aluminum represents the more attractive alternative. Various alternative to the illustrated manual winch are to be considered equivalent for purposes of this invention including but not limited to the use of an electric powered hoist. Optionally, the axles and the boom can be of fixed length rather than retractable. And, the relative positions of various components and the choice of means to allow them to join and articulate with respect to each other can be by essentially any of the methods well known in the art. For example, the winch instead of resting on the winch stand can be attached directly to the frame or even below it, preferably near the rear of the frame to serve as ballast. However, this winch can also be advantageously attached to the midsection of the frame to allow the rear of the frame for supporting ballast. It is also invisioned that the winch can be mounted on a folding stand, on or off center to facilitate compactness during transportation. Also the ballast support means does not necessarily have to act simultaneously as the backpackable means and as such can be detached or fold into the frame during transportation. Optionally appropriate brakes can be provided on the wheels or axles. The relative attachment point of the boom or jib can be shifted to the rear of the frame with a folding rigid boom support leg being provided at the front. In fact, it is contemplated that a friction drum, rope and rope brake can be provided on the unit using the same boom for quickly lowering objects from roofs and the like.

Having thus described the preferred embodiments with a certain degree of particularity, it is manifest that many changes can be made in the details of construction, arrangement and fabrication of the elements and their uses without departing from the spirit and scope of the invention. Therefore, it is to be understood that the invention is not limited to the embodiments set forth herein for purposes of exemplification, but is to be limited only by the scope of the attached claims, including a full range of equivalents to which each element thereof is entitled.

We claim:

1. A portable lift comprising:

(a) a frame mounted on wheels such that said frame is essentially horizontal during operation;

(b) a boom pivotally attached to one end of said frame and adapted to extend beyond said frame during operation and fold back upon said frame during transportation and storage;

(c) a boom support means attached to said frame and adapted to maintain said boom in an elevated position during operation and fold back upon said frame during transportation and storage;

(d) a hoist with hoist cable attached to said frame with said hoist cable threaded through a pulley on the end of said boom for raising a load attached to the end of said cable; and (e) a carrying means for assisting in the manual transportation of said portable lift when folded, said carrying means comprising a backpackable means removably attached to said frame and adapted to strap to shoulders during manual transportation and further adapted during operation to attach to said frame and to extend horizontally away from said boom such as to accept ballast to compensate for said load to be elevated by said lift.

2. A portable lift of claim 1 wherein said hoist cable also threads through a pulley attached to said frame.

* * * * *